US007290530B2

(12) United States Patent
Boecking

(10) Patent No.: US 7,290,530 B2
(45) Date of Patent: Nov. 6, 2007

(54) FUEL INJECTION DEVICE

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/565,561

(22) PCT Filed: Jun. 9, 2004

(86) PCT No.: PCT/DE2004/001200

§ 371 (c)(1),
(2), (4) Date: Jan. 23, 2006

(87) PCT Pub. No.: WO2005/010342

PCT Pub. Date: Feb. 3, 2005

(65) Prior Publication Data

US 2007/0001032 A1 Jan. 4, 2007

(30) Foreign Application Priority Data

Jul. 24, 2003 (DE) ..... 103 33 696

(51) Int. Cl.
*F02M 37/04* (2006.01)

(52) U.S. Cl. ..... 123/467; 123/501

(58) Field of Classification Search ..... 123/467, 123/446, 500, 501, 502; 236/88–96
See application file for complete search history.

(56) References Cited

U.S. PATENT DOCUMENTS 6,067,955 A * 5/2000 Boecking ..... 123/299
6,260,541 B1 7/2001 Ricci-Ottati et al.
6,422,211 B1 * 7/2002 Boecking ..... 123/501
6,484,697 B2 * 11/2002 Boecking ..... 123/467
6,719,264 B2 4/2004 Mattes (Continued)

FOREIGN PATENT DOCUMENTS

DE 198 56 617 A1 6/2000

(Continued)

*Primary Examiner*—Carl S. Miller
(74) *Attorney, Agent, or Firm*—Ronald E. Greigg

(57) ABSTRACT

A fuel injection system having an injection valve, a line supplying fuel at high pressure to the injection valve a control valve controlling the pressure in a control chamber communicating with the line. The control valve has a movable valve part is actuatable by an actuator via a hydraulic coupler having two pistons cooperating with a booster chamber of the coupler. A seat of the movable valve part has an inside cross-sectional area f3, with means for filling the booster chamber via guide gaps of the pistons with fuel under pressure. The pistons are located parallel to and inside one another and a booster chamber is located on the ends of the pistons toward the actuator. In the interior of the outer piston defines a filling chamber which communicates with the line and one of the pistons has a cross-sectional area f4 is mechanically coupled to the actuator via a rod having a cross-sectional area f5. The other piston which has a piston area f2, actuates the control valve via a rod having a cross-sectional area that is smaller than f2 and the direction of the closing motion of the movable valve part matches the direction of fuel flowing out of the control chamber so that the control valve is at least partially force-balanced because of the pressure acting on the further piston in the booster chamber.

2 Claims, 1 Drawing Sheet

U.S. PATENT DOCUMENTS

| | | | | |
|---|---|---|---|---|
| 6,725,841 | B1 * | 4/2004 | Boecking | 123/467 |
| 6,817,542 | B2 | 11/2004 | Boecking | |
| 6,820,820 | B1 | 11/2004 | Boecking | |
| 6,877,483 | B2 * | 4/2005 | Askew | 123/467 |
| 6,915,785 | B2 * | 7/2005 | Eisenmenger et al. | 123/446 |
| 6,994,272 | B2 * | 2/2006 | Kurrle et al. | 239/96 |

FOREIGN PATENT DOCUMENTS

| | | | |
|---|---|---|---|
| DE | 199 51 004 | A1 | 4/2001 |
| DE | 100 19 765 | A1 | 10/2001 |
| DE | 101 01 802 | A1 | 7/2002 |
| DE | 101 45 622 | A1 | 4/2003 |

* cited by examiner

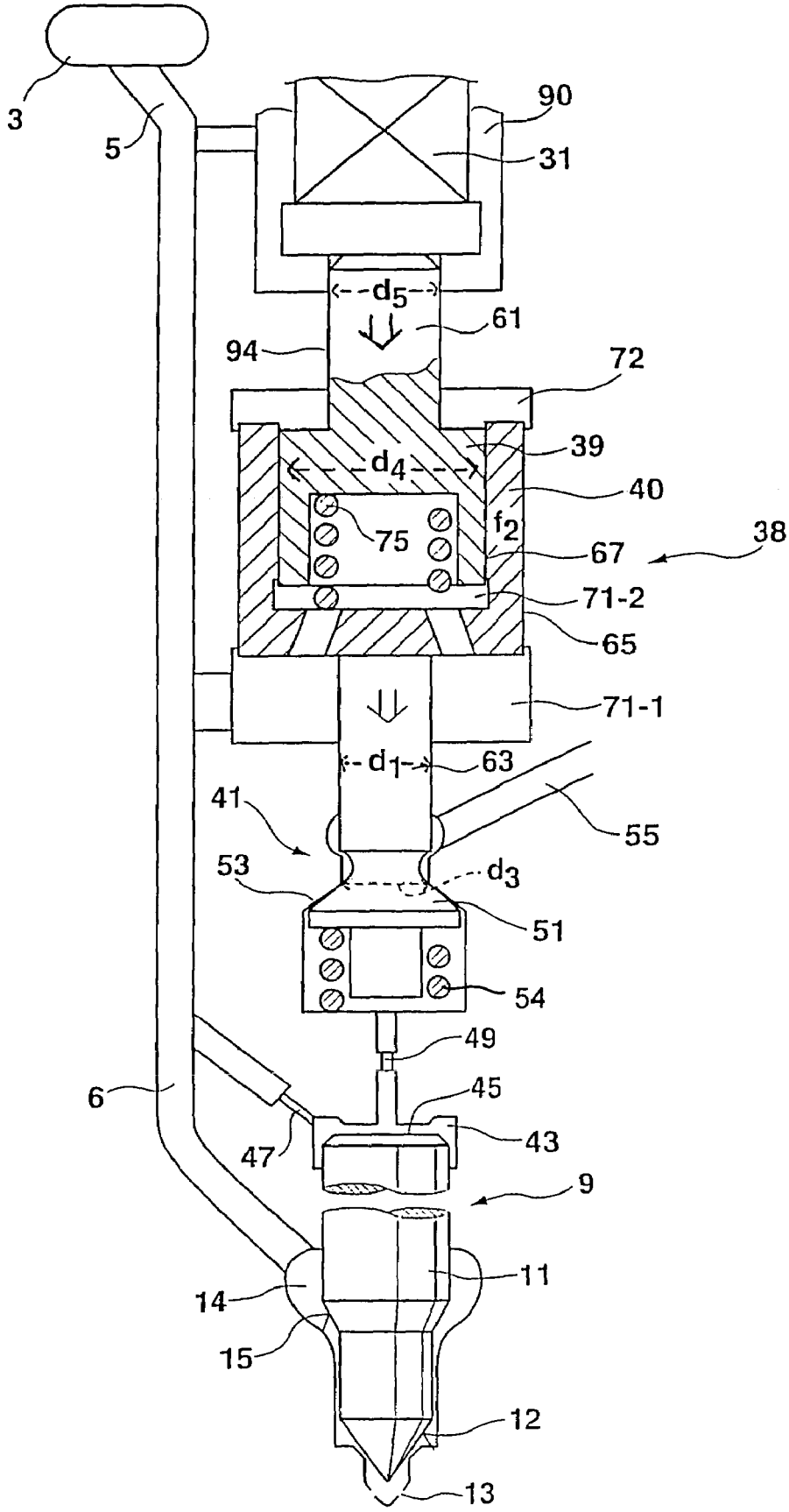
3
5
90
31
d5
61
94
72
39
d4
40
75
f2
38
67
71-2
65
71-1
d1
63
41
55
53
d3
51
54
49
6
45
43
47
9
11
14
15
12
13

FUEL INJECTION DEVICE

CROSS-REFERENCE TO RELATED APPLICATIONS

This application is a 35 USC 371 application of PCT/DE 2004/001200 filed on Jun. 9, 2004.

BACKGROUND OF THE INVENTION

1. Field of the Invention

The invention is directed to an improved fuel injection system for an internal combustion engine.

2. Description of the Prior Art

A common rail injector (hereinafter. CR stands for "common rail") with a piezoelectric actuator (or piezoelectric controller) and with boosting by hydraulic couplers is known. Integrated couplers with pistons disposed coaxially inside one another are also known. One known device uses an outward-opening valve as a control valve. This valve can be embodied with only a relatively small diameter, since otherwise the forces on the valve become too high, so that it cannot be actuated by a piezoelectric actuator.

SUMMARY AND ADVANTAGES OF THE INVENTION

The fuel injection system of the invention for internal combustion engines has the advantage over the prior art that a common rail injector with a piezoelectric actuator is created, in which a large cross section of the valve is possible. As a result, the opening and closing of the injection valve can be effected faster. The integrated coupler makes a short structural length of the device possible. The coupler is reinforced by CR pressure.

BRIEF DESCRIPTION OF THE DRAWING

One exemplary embodiment of the fuel injection system of the invention is described more fully herein below, with reference to the sole drawing figure which shows the essential components of a fuel injection system of the invention, with an injection valve and a control valve as well as a hydraulic coupler.

DESCRIPTION OF THE PREFERRED EMBODIMENT

The fuel injection system of the invention is supplied with fuel at high pressure by a pressure reservoir (common rail) 3 via a high-pressure line 5, from which fuel flows via an injection line 6 to reach an injection valve 9. An internal combustion engine normally has several such injection valves, and for the sake of simplicity only one is shown. The injection valve 9 has a valve needle (valve piston, nozzle needle) 11, which in its closing position, with a conical valve sealing face 12, closes injection openings 13 through which fuel is to be injected into the interior of a combustion chamber of the engine. The fuel reaches the vicinity of the nozzle needle via an annular nozzle chamber 14, from which, via a control face 15 embodied as a pressure shoulder, it makes it possible to exert a pressure in the opening direction of the nozzle needle. When this pressure exerts a force in the opening direction on the valve needle that overcomes forces acting counter to this opening, the valve opens.

For controlling the opening and closing of the injection openings, an actuator 31 is used. As a function of a triggering at a mechanical outlet, this actuator generates a deflection and a force for actuating further elements. In this example, it is an electrically actuated actuator namely a piezoelectric actuator. The actuator takes on a lengthened configuration or a shortened configuration as a function of an electrical triggering in the vertical direction of the drawing, and thus in its own longitudinal direction. In this example, an actuator is provided with a construction such that when current is supplied (upon connection to a source of direct current), it assumes a lengthened configuration but without current it assumes a shortened configuration. The actuator forms a capacitive load, and when current is supplied continuously, it does not absorb any lost power. It may be advantageous or necessary to prestress the piezoelectric actuator by a tensing device, such as a spring, such that piezoelectric elements contained in the actuator are constantly in compression. This is familiar to those skilled in the art and will therefore not be discussed below. While the upper end of the piezoelectric actuator is anchored in the injection device in a manner not visible in the drawing, the lower end of the piezoelectric actuator serves to use its force and motion in the final analysis for opening and closing the injection openings. To that end, a hydraulic coupler 38 is provided for its coupling; the hydraulic coupler has one piston 39 coupled to the piezoelectric actuator and one further piston 40. In the present application, by means of the coupler, an increase in the travel of the further piston 40 in comparison to the travel of the piston 39 is generally necessary (by means of a suitable choice of the hydraulically operative piston areas). The construction and mode of operation of the hydraulic coupler will be described hereinafter.

When the piston 40 of the hydraulic coupler that is not directly connected to the piezoelectric actuator opens a control valve 41 (or outlet valve), the pressure in a fuel-filled control chamber 43, the inside of which is engaged by the upper end portion of the nozzle needle, drops. The control chamber 43 is filled with fuel underpressure via an inlet throttle 47, and when the control valve 41 is opened, fuel flows out of the control chamber 43 via an outlet throttle 49. The outflow of fuel is reinforced by forces that seek to move the nozzle needle 11 into its open position. When the control valve 41 is closed, a movable valve piece 51 rests in sealing fashion on a valve seat 53 and is mechanically coupled to the piston 40. The control quantity flowing out of the control chamber when the valve piece 51 is opened is carried away through a leak fuel conduit 55. When the valve piece 51 is closed, it is acted upon from the control chamber by rail pressure (that is, pressure in the line 5); the pressure acts on the face having the diameter d3.

The pistons 39 and 40, in this example, are parallel to one another and inside one another, coaxially inside one another (integrated coupler), which is advantageous from a production standpoint. The way in which they are coupled to one another will be explained hereinafter. An arrow is shown in the piston 39, indicating the motion of this piston when the actuator executes a motion downward in terms of the drawing. In the piston 40, an arrow is shown which indicates the motion of that piston when the piston 39 executes its motion indicated by its arrow. By comparing the arrow of the piston 40 with the direction in which the movable valve element of the valve, to be actuated by the hydraulic converter 38, must be moved for opening and for closing, it can be seen directly from the drawing whether the direction shown in the drawing by the aforementioned arrows corresponds to an opening event or a closing event of the aforementioned valve.

The movable valve piece 51 is embodied essentially conically, with a cylindrical extension. In particular, in the closed state, it rests with a conical part on the valve seat 53. The valve piece 51 is prestressed in the direction of its valve seat 53 by a compression spring 54 that is guided by the cylindrical extension. In its blocking position, it has been moved "outward", namely in the direction from the high pressure in the control chamber 43 to a region of lower pressure (leak fuel pressure). The outlet valve is in this case therefore called an outward-opening valve. The side of the valve piece 51 facing toward the valve seat 53 is rigidly connected to an actuating part that is connected to the hydraulic coupler. The connection to the piston 40 is advantageously tensionproof, for the sake of especially fast closing.

The actuator 31 is connected to the piston 39 by a rod 61 having a diameter d5. The piston 40 is connected to the movable valve part 51, to be actuated by it, by a rod 63 having a diameter d1. The inner piston 39 has a diameter d4; the outer piston 40 has a circular piston face whose area is f2. The inside diameter of the valve seat 53 at the place where the movable valve part rests on it is d3.

Guide gaps 65 and 67, which serve to guide the piston in sliding fashion and through which a booster chamber is filled with fuel, are formed in the region of the cylindrical outer face of the outer piston (diametrically opposite a housing, not shown) and in the region of the mutual sliding guidance of the two pistons.

The areas f1, f3 through f5 corresponding to the aforementioned diameters d1, d3 through d5 (for circular cross sections) and the aforementioned area f2 are definitive for the function. Circular cross sections are indeed expedient from a production standpoint, but the invention is not limited to them.

The end regions of the pistons 39 and 40 oriented toward the actuator 31 engage the inside of a common booster chamber 72. The other end region of the piston 39 engages the inside of a filling chamber 71-2; this chamber communicates via bores in the lower end wall of the piston 40 with filling chamber 71-1 which communicates with the line 5. The other end region of the inner piston 40 protrudes into the filling chamber 71-2. Via the guide gaps 65 and 67, the booster chamber 72 is filled. The booster chamber 72 is penetrated by the rod 61. The filling chamber 71-1 is penetrated by the rod 63. The pistons 39 and 40 move in opposite directions from one another, and they also, because of the desired travel boosting from the actuator to the control valve, move at different speeds.

The actuator 31 (piezoelectric controller) is supplied with current and lengthened, in the closed state of the injection valve 9. For opening the control valve 41, the electric current to the actuator 31 is switched off, and the actuator becomes shorter. As a result, the piston 39 (first booster piston) is moved upward in the drawing, reinforced by the spring 75 and by the pressure in the filling chamber 71-2. In the booster chamber 72 and in the filling chamber 71-2, CR pressure (that is, pressure of the pressure reservoir or common rail) is the system pressure in the state of repose. In the booster chamber, as a result with the upward motion of the piston 39, the pressure increases. This pressure increase moves the piston 40 (second booster piston) downward and, by motion of the valve part 51 oriented in the same direction, opens the control valve 41, which is an outward-opening valve. For fast closure of the valve part 51, this part is preferably solidly connected to the rod 63 and thus to the piston 40. Because of the CR pressure in the booster chamber 72, the seat diameter d3 of the valve part 51 can be selected to be quite large, since the piston 40 largely compensates for this area with its side located in the booster chamber 72. The invention thus creates an advantageous outward-opening valve/servo injector with CR pressure reinforcement for very fast opening and closing of the injection valve. The coupler assures a short structural length.

One important characteristic of the invention is that rail pressure is applied to the side of the piston 39 (in the booster chamber) that faces away from the control valve; this rail pressure reinforces the actuation of the control valve and acts counter to the pressure exerted from the control chamber 43 on the valve part 51 in the blocking state.

Because of the rail pressure in the booster chamber 72, d3 is largely force-balanced. In comparison to the prior art, a greater excess of force, which is furnished by the actuator to accelerate the mass of the movable valve part, is therefore available. The invention accordingly creates a variant with a partially-compensated (=partially balanced relative to the force) control valve, and this valve is an outward-opening valve. The force to be furnished by the actuator for closing the valve is therefore less than in the known art. Instead, in one version, a valve 51 with a greater diameter d3 than in the known art is provided, which enables a faster opening and closing of the injection valve, because the increase and decrease in the flow in it is greater than in the known, smaller outward-opening valve.

A compression spring 75 in the filling chamber 71-2 forces the pistons apart and assures good contact of the coupler with the actuator 31 and, when the valve is closed, of the valve part 51 on the valve seat 53.

The system shown has still further characteristics. At least in one region of the rod 61, connecting the actuator 31 to the hydraulic coupler, at a distance from the chamber of the coupler closest to the actuator 31, there is a further filling chamber 90, which communicates with the line 5. In this example, the further filling chamber 90 surrounds the actuator 31 in its lower end region. Preferably, it surrounds the entire actuator 31. A guide gap 94 of the rod 61 is dimensioned for additional filling of the adjacent chamber 72 of the coupler with fuel that is under pressure. One advantage is in the additional filling of the coupler with fuel that is at high pressure.

In some versions of the invention the further filling chamber 90 is either not present or does not communicate with the line 5 and does not have the function of a filling chamber. In that case it may be expedient for a bore, in which the rod 61 is guided in a housing, not shown, of the entire system, to be dimensioned for the least possible outflow of fuel from the coupler.

The invention also includes versions in which the fuel that is at high pressure is not delivered from a high-pressure reservoir but rather from a pump associated with the injection valve (such as a unit fuel injector) that also supplies the filling chamber.

The foregoing relates to preferred exemplary embodiments of the invention, it being understood that other variants and embodiments thereof are possible within the spirit and scope of the invention, the latter being defined by the appended claims.

The invention claimed is:

1. In a fuel injection system having an injection valve, a line supplying fuel at high pressure to the injection valve in operation, a control valve which controls the pressure in a control chamber of the injection valve that communicates with the aforementioned line, the control valve including movable valve part actuatable by an actuator via a hydraulic coupler that has two pistons, cooperating with a booster chamber of the coupler, the seat of the movable valve part has an inside cross-sectional area f3, and the pistons having guidance gaps through which the booster chamber is filled with fuel that is under pressure, the improvement wherein the pistons are located parallel to one another with one inside the other; the booster chamber being located on the ends of the pistons toward the actuator, a filling chamber provided in the interior of the outer piston, the filling chamber communicating with the aforementioned line; and rod means mechanically coupling a cross-sectional area f4 of the one piston to the actuator, the rod means having a cross-sectional area f5; the other piston, having a piston area f2 and actuating the control valve via a rod having a cross-sectional area that is smaller than f2; the direction of the closing motion of the movable valve part matching the direction of fuel flowing out of the control chamber, so that the control valve is at least partially force-balanced because of the pressure acting on the further piston in the booster chamber.

2. The fuel injection system according to claim 1, further comprising a further filling chamber, which communicates with the aforementioned line and is in communication with the coupler via a guide gap of the rod at least in one region of the rod, connecting the actuator to the hydraulic coupler, at a distance from the chamber of the coupler that is closest to the actuator.

* * * * *